US011065873B2

(12) United States Patent
Katayama et al.

(10) Patent No.: US 11,065,873 B2
(45) Date of Patent: Jul. 20, 2021

(54) LIQUID EJECTION APPARATUS

(71) Applicant: Brother Kogyo Kabushiki Kaisha, Nagoya (JP)

(72) Inventors: Hiroshi Katayama, Toyoake (JP); Shohei Koide, Nagoya (JP); Keita Hirai, Nagoya (JP); Keita Sugiura, Toyokawa (JP)

(73) Assignee: Brother Kogyo Kabushiki Kaisha, Nagoya (JP)

( * ) Notice: Subject to any disclaimer, the term of this patent is extended or adjusted under 35 U.S.C. 154(b) by 0 days.

(21) Appl. No.: 16/835,632

(22) Filed: Mar. 31, 2020

(65) Prior Publication Data

US 2020/0307203 A1 Oct. 1, 2020

(30) Foreign Application Priority Data

Apr. 1, 2019 (JP) ..... JP2019-069685

(51) Int. Cl.
*B41J 2/14* (2006.01)
*B41J 2/175* (2006.01)

(52) U.S. Cl.
CPC ..... *B41J 2/14145* (2013.01); *B41J 2/175* (2013.01)

(58) Field of Classification Search
CPC .... B41J 2/14145; B41J 2/14016; B41J 2/175; B41J 2/18; B41J 2/1752; B41J 2/17513; B41J 2/17553
USPC ..... 347/20, 84, 85
See application file for complete search history.

(56) References Cited

U.S. PATENT DOCUMENTS 10,549,539 B2 * 2/2020 Katayama ..... B41J 2/14209
10,583,657 B2 * 3/2020 Sugiura ..... B41J 2/1433
10,596,810 B2 * 3/2020 Suzuki ..... B41J 2/04573

FOREIGN PATENT DOCUMENTS

JP 2008-290292 A 12/2008

* cited by examiner

*Primary Examiner* — An H Do
(74) *Attorney, Agent, or Firm* — Banner & Witcoff, Ltd.

(57) ABSTRACT

A liquid ejection apparatus includes a supply manifold, a return manifold, and a plurality of individual channels. The supply manifold and the return manifold are elongate and vertically overlap each other, and liquid flows therein. Each individual channel connects the supply manifold and the return manifold and includes a supply throttle connected, at a supply-manifold-side opening thereof, to the supply manifold, a return throttle connected, at a return-manifold-side opening thereof, to the return manifold, a nozzle from which liquid is ejected, and a descender connecting the supply throttle and the return throttle, and connected to the nozzle. The supply-manifold-side opening of the supply throttle is positioned to vertically overlap a central area of the supply manifold in a width direction, and the return-manifold-side opening of the return throttle is positioned to vertically overlap a central area of the return manifold in the width direction.

10 Claims, 3 Drawing Sheets

LIQUID EJECTION APPARATUS

CROSS-REFERENCE TO RELATED APPLICATION

This application claims priority from Japanese Patent Application No. 2019-069685 filed on Apr. 1, 2019, the content of which is incorporated herein by reference in its entirety.

TECHNICAL FIELD

Aspects of the disclosure relate to a liquid ejection apparatus configured to eject liquid from nozzles.

BACKGROUND

A known liquid ejection apparatus includes a supply manifold and a return manifold which are elongate and vertically overlap each other, and further includes a plurality of individual channels each connecting the supply manifold and the return manifold.

Each individual channel includes a pressure chamber for applying pressure to liquid supplied from the supply manifold, a passage through which liquid supplied from the pressure chamber flows, and a nozzle located in the middle of the passage. Each individual channel is connected, at its upstream end, to an end of the supply manifold in a width direction and connected, at its downstream end, to an end of the return manifold in a width direction.

A pump disposed at an exterior of the liquid ejection apparatus applies a positive pressure to the supply manifold, thereby circulating liquid in the channels in the apparatus from the supply manifold toward the return manifold. In this state, upon application of pressure selectively to liquid in a pressure chamber, a part of circulating liquid is ejected from a corresponding nozzle.

SUMMARY

In the known liquid ejection apparatus, the liquid flow velocity is low at a side of the supply manifold in a width direction, and any air entrained in the supply manifold is unlikely to be discharged from the supply manifold. Likewise, the liquid flow velocity is low at a side of the return manifold in a width direction, and any air entrained in the return manifold is unlikely to be discharged from the return manifold. This may cause air to remain for a long time in a channel in the apparatus. A change in flow velocity of liquid in the apparatus may cause a particular component, e.g., a colorant component, of liquid to settle in a channel, resulting in a clog of the channel. Such entrained air and/or settled particular component may degrade liquid ejection performance.

Aspects of the disclosure provide a liquid ejection apparatus including a plurality of individual channels each connecting a supply manifold and a return manifold which are elongate and vertically overlap each other, and being configured to maintain proper liquid ejection performance while reducing entrainment of air and/or settling of a particular component of liquid.

According to one or more aspects of the disclosure, a liquid ejection apparatus includes a supply manifold, a return manifold, and a plurality of individual channels. The supply manifold is elongate and liquid flows therein. The return manifold is elongate and liquid flows therein. The return manifold vertically overlaps the supply manifold. The plurality of individual channels each connect the supply manifold and the return manifold. Each of the plurality of individual channels includes a supply throttle connected, at a supply-manifold-side opening thereof, to the supply manifold, a return throttle connected, at a return-manifold-side opening thereof, to the return manifold, a nozzle from which liquid is ejected, and a descender connecting the supply throttle and the return throttle, and connected to the nozzle. The supply-manifold-side opening of the supply throttle is positioned to vertically overlap a central area of the supply manifold in a width direction, and the return-manifold-side opening of the return throttle is positioned to vertically overlap a central area of the return manifold in the width direction.

BRIEF DESCRIPTION OF THE DRAWINGS

Aspects of the disclosure are illustrated by way of example and not by limitation in the accompanying figures in which like reference characters indicate similar elements.

DETAILED DESCRIPTION

Illustrative embodiments of the disclosure will be described with reference to the drawings.

First Illustrative Embodiment

Overall Structure of Printer

Figure 1:
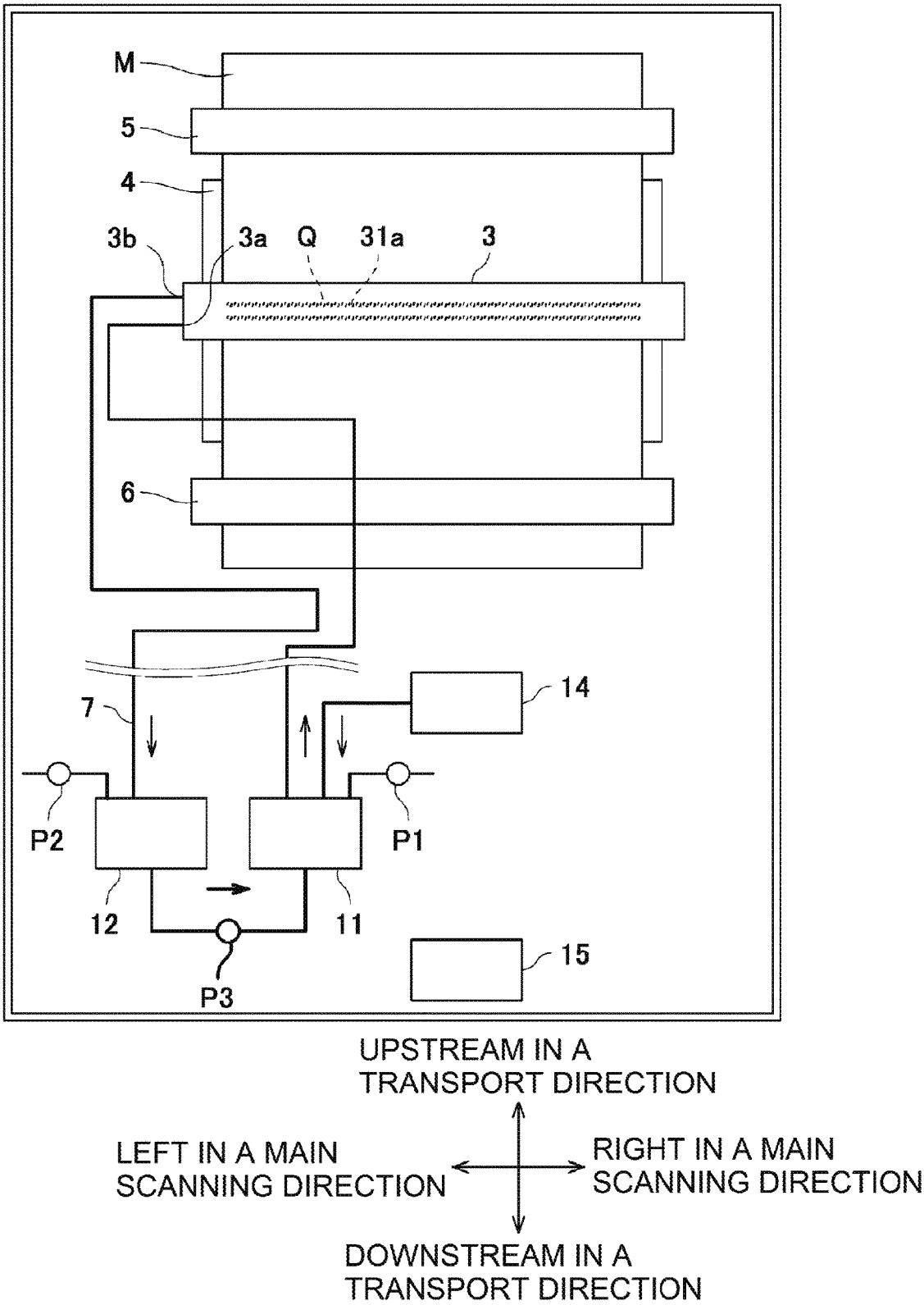
FIG. 1 is a schematic configuration diagram of a printer according to a first illustrative embodiment.

FIG. 1 is a schematic configuration of a printer 1 according to a first illustrative embodiment. A liquid ejection apparatus, e.g., a printer 1, may be a line printer, but is not so limited. As shown in FIG. 1, the printer 1 includes a liquid ejection head 3, a platen 4, transport rollers 5 and 6, a pressure tank 11, a negative-pressure tank 12, air pumps P1 and P2, a liquid pump P3, a supply tank 14, and a controller 15. The printer 1 ejects a liquid containing, for example, a colorant component but may eject other liquids containing particular components.

The liquid ejection head 3 as an example of a liquid ejection apparatus is disposed to face the platen 4 with an interval therebetween. As described in detail later, the liquid ejection head 3 includes a plurality of nozzles 31*a* for liquid ejection, an inlet 3*a*, and an outlet 3*b*.

One end of a conduit 7 is connected to the inlet 3*a* and the other end of the conduit 7 is connected to the outlet 3*b*. The pressure tank 11, the liquid pump P3, and the negative-pressure tank 12 are connected to the conduit 7 in this order from the inlet 3*a* toward the outlet 3*b*. The pressure tank 11 stores liquid therein. Connected to the pressure tank 11 are the air pump P1 for pneumatically pressurizing liquid, and the supply tank 14 for supplying liquid to the pressure tank 11. The air pump P1 increases the pressure of air in the pressure tank 11, thereby pressurizing the liquid in the pressure tank 11 and supplying the liquid to the conduit 7.

The negative-pressure tank 12 stores liquid therein. Connected to the negative-pressure tank 12 is the air pump P2 for pneumatically pressurizing liquid. The air pump P2 decreases the pressure of air in the negative-pressure tank 12, thereby drawing a part of liquid flowing in the conduit 7 into the negative-pressure tank 12.

The liquid pump P3 is disposed between the tanks 11 and 12 in the conduit 7. The liquid pump P3 supplies liquid from the negative-pressure tank 12 to the pressure tank 11. As the pumps P1 through P3 are driven in the printer 1, liquid circulates in the conduit 7 and inner portions of the liquid ejection head 3.

The platen 4 is disposed to face the nozzles 31*a* of the liquid ejection head 3 and extends in a scanning direction and in a transport direction perpendicular to the scanning direction. The platen 4 supports thereon a recording sheet M. The transport rollers 5 and 6 transport the recording sheet M in the transport direction. The transport roller 5 is disposed upstream of the liquid ejection head 3 in the transport direction. The transport roller 6 is disposed downstream of the liquid ejection head 3 in the transport direction.

The controller 15 separately controls the pumps P1 through P3 and actuators 41 (refer to FIG. 2) to be described later. By way of example, the controller 15 may serve as a controller to control the pumps P1 through P3 and also as a controller to control the actuators 41. However, the pumps P1 through P3 and the actuators 41 may be controlled by separate controllers.

The controller 15 controls in the printer 1 such that the liquid ejection head 3 ejects liquid, e.g., ink, from the nozzles 31*a* each time the transport rollers 5 and 6 transport a recording sheet M by a predetermined distance in the transport direction. The printer 1 thereby prints on the recording sheet M. The printer 1 may include a plurality of liquid ejection heads for ejecting different kinds of liquids (e.g., inks of different colors).

Liquid Ejection Head

Figure 2:
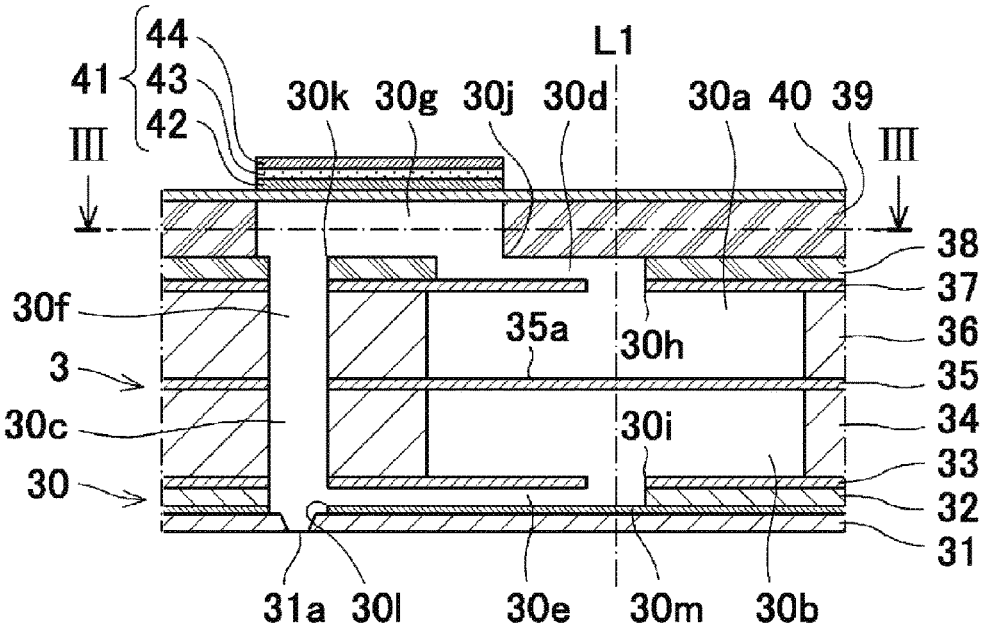
FIG. 2 is a partial cross-sectional view of a liquid ejection head of the printer of FIG. 1.
Figure 3:
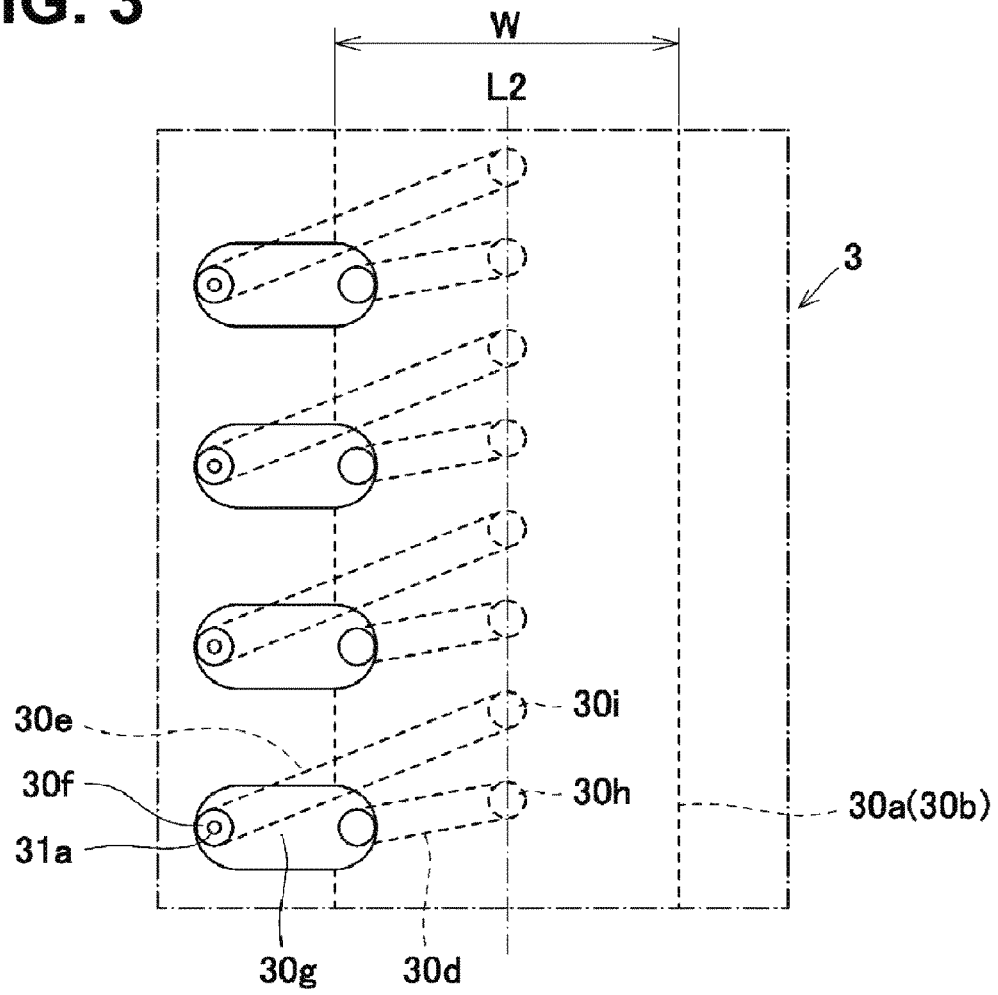
FIG. 3 is a cross-sectional view of the liquid ejection head taken along line III-III in FIG. 2.

FIG. 2 is a partial cross-sectional view of the liquid ejection head 3 of FIG. 1. FIG. 3 is a partial cross-sectional view taken along line in FIG. 2. An up-down direction of the page of FIG. 3 corresponds to a lift-right direction (e.g., a main scanning direction) of the page of FIG. 1. FIGS. 1 through 3 show the liquid ejection head 3, e.g., an inkjet head. The liquid ejection head 3 includes a channel unit 30 formed by vertically stacking a plurality of plates 31 through 40, and the actuators 41 disposed on an upper surface of the channel unit 30.

The lowermost plate 31 is a nozzles plate including the nozzles 31*a* formed therethrough in a thickness direction. Nozzle arrays Q, each of which includes a predetermined number of nozzles 31*a*, are arranged parallel to each other, at an interval from each other in a sub-scanning direction (the transport direction, e.g., the left-right direction in FIGS. 2 and 3). The nozzles 31*a* of each nozzle array Q are arranged at intervals in the main scanning direction (e.g., a direction facing into and out of the page of FIG. 2 and the up-down direction in FIG. 3).

Hereinafter, a direction of the nozzles 31*a* arrayed in each nozzle array Q is referred to as a nozzle array direction. The nozzle array direction corresponds to the main scanning direction. A stacking direction of the plates 31 through 40, which is also simply referred to as a stacking direction, corresponds to the up-down direction. A width direction of the liquid ejection head 3 (hereinafter also simply referred to as a width direction) is perpendicular to the stacking direction and the nozzle array direction.

The channel unit 30 includes a supply manifold 30*a*, a return manifold 30*b*, and a plurality of individual channels 30*c*. The supply manifold 30*a* and the return manifold 30*b*, in which fluid flows, are elongate and positioned to overlap each other in the stacking direction. By way of example, the supply manifold 30*a* and the return manifold 30*b* extend in the nozzle array direction and are connected to each other in the stacking direction at an upstream position in the nozzle array direction, via a communication passage (not shown). In this embodiment, the supply manifold 30*a* and the return manifold 30*b* are similar in cross-sectional shape and have a dimension W in the width direction is greater than a dimension in a height direction. The supply manifold 30*a* and the return manifold 30*b* are partitioned by the plate 35 except for their connecting portion.

Each individual channel 30*c* is provided separately for a corresponding nozzle 31*a* and is connected to the supply manifold 30*a* and to the return manifold 30*b*. Each individual channel 30*c* defines a flow path and includes a supply throttle 30*d*, a return throttle 30*e*, a descender 30*f*, and a pressure chamber 30*g*.

A supply throttle 30*d* is connected to the supply manifold 30*a*. The supply throttle 30*d* is positioned above the supply manifold 30*a* and extends in the width direction from the inside toward the outside of the width of the supply manifold 30*a*. By way of example, an upstream end of the supply throttle 30*d* is connected to the supply manifold 30*a*, via an opening 30*h* near the supply manifold 30*a*, and a downstream end of the supply throttle 30*d* is connected to a pressure chamber 30*g*, via an opening 30*j*. The opening 30*h* is defined by the adjacent plates 37 and 38. The opening 30*j* is defined by the adjacent plates 38 and 39.

A return throttle 30*e* is connected to the return manifold 30*b*. The return throttle 30*e* is positioned below the return manifold 30*b* and extends in the width direction from the inside toward the outside of the width of the supply manifold 30*b*. By way of example, an upstream end of the return throttle 30*e* is connected to a descender 30*f*, via an opening 30*l*, and a downstream end of the return throttle 30*e* is connected to the return manifold 30*b*, via an opening 30*i*. The opening 30*l* is defined by the adjacent plates 31, 32, and 33. The opening 30*i* is defined by the adjacent plates 32 and 33.

A descender 30*f* connects the supply throttle 30*d* and the return throttle 30*e*. The descender 30*f* is connected to a nozzle 31*a*. By way of example, the descender 30*f* extends in the stacking direction at a position outside the width of the supply manifold 30*a* and the return manifold 30*b*. An upstream end of the descender 30*f* is connected to a pressure chamber 30*g*, via an opening 30*k*, and a downstream end of the descender 30*f* is connected to the nozzle 31*a*. A side of a downstream end of the descender 30*f* is in communication with the opening 30*l*. The opening 30*l* is defined by the plate 38.

The pressure chamber 30*g* is positioned between the supply throttle 30*d* and the descender 30*f* and apply pressure to liquid supplied from the supply throttle 30*d* to supply the liquid to the descender 30*f*. The pressure chamber 30*g* is positioned above the supply throttle 30*d* and extends in the width direction from the inside to the outside of the supply manifold 30*a*. In this embodiment, the pressure chamber 30*g* overlaps the descender 30*f* in the stacking direction. An upper end of the pressure chamber 30*g* is defined by a plate 40 (e.g., a vibration plate) which is elastically deformable in a thickness direction.

Each actuator 41 is disposed on an upper surface of the plate 40 to overlap a corresponding pressure chamber 30*g* in the stacking direction. Each actuator 41 includes a common electrode 42, a piezoelectric layer 43, and an individual electrode 44. The common electrode 42, the piezoelectric layer 34, and each individual electrode 44 are stacked, in this order, on an upper surface of the plate 40. The common electrode 42 and the piezoelectric layer 43 are commonly disposed over a nozzle array Q, and each individual electrode 44 is disposed over a corresponding pressure chamber 30*g*. The piezoelectric layer 43 is made of a piezoelectric material containing lead zirconate titanate (PZT).

The common electrode 42 is maintained at a ground potential. The common electrode 44 is connected to a driver integrated circuit (IC) (not shown) of the printer 1. The driver IC separately sets each individual electrode 44 at a ground potential or a predetermined driving potential. A portion of the piezoelectric layer 43 sandwiched between the common electrode 42 and an individual electrode 44 functions, as an active portion polarized in the stacking direction, when the individual electrode 44 is energized.

In order not to cause the nozzles 31*a* to eject liquid (in order to put the actuators 41 in a standby state), all the individual electrodes 44 are maintained at a ground potential, similarly to the common electrode 42. In order to cause a particular nozzle 31*a* to eject liquid, the controller 15 switches to a driving potential for the individual electrode 44 of an actuator 41 corresponding to the pressure chamber 30*g* connected to the particular nozzle 31*a*. The actuator 41 thereby deforms to protrude into the pressure chamber 30*g*.

This reduces the volume of the pressure chamber 30*g* and increases the pressure (positive pressure) of liquid in the pressure chamber 30*g*. Thus, liquid is ejected from the particular nozzle 31*a*. After the liquid is ejected, the individual electrode 44 is reset to a ground potential. This returns the deformed actuator 41 to an original state.

The controller 13 selectively controls some of the actuators 41 not involving liquid ejection, to deform so as to retract from the liquid. In this case, the actuators 41 deform to be recessed from the corresponding pressure chambers 41.

This increases the volume of each corresponding pressure chamber 30*g* and makes the pressure of liquid in the pressure chamber 30*g* negative. Thus, undesirable liquid ejection from the nozzles 31*a* may be reduced or prevented. Various ways are known to control a voltage to be applied to the actuators 41 for liquid ejection from the nozzles 31*a*. Thus, other known ways of control may be adapted to control the printer 1.

In the channel unit 30, a supply-manifold-side opening 30*h* of each supply throttle 30*d* is a connecting port to the supply manifold 30*a* and is positioned to vertically overlap a central area of the supply manifold 30*a* in the width direction. Likewise, a return-manifold-side opening 30*i* of each return throttle 30*e* is a connecting port to the return manifold 30*b* and is positioned to vertically overlap the central area of the return manifold 30*b* in the width direction.

Herein, "a central area of the supply manifold 30*a* in the width direction" indicates an area between two positions which are away, in opposite directions along the width direction, from a center of the supply manifold 30*a* in the width direction by half (½) the inside diameter of the opening 30*h*. An axis of the supply-manifold-side opening 30*h* is located in this central area. Herein, "a central area in the width direction of the return manifold 30*b*" indicates an area between two positions which are away, in opposite directions along a width direction, from a center of the return manifold 30*b* in the width direction by half (½) the inside diameter of the opening 30*i*. An axis of the supply-manifold-side opening 30*i* is located in this central area.

A straight line L1 in FIG. 2 shows a straight line which, when viewed in the nozzle array direction of the liquid ejection head 3, passes through a center of the manifold 30*a* in the width direction and a center of the manifold 30*b* in the width direction. A straight line L2 in FIG. 3 shows a straight line which, when viewed in the stacking direction of the liquid ejection head 3, passes through a center of the manifold 30*a* in the width direction and a center of the manifold 30*b* in the width direction. As shown in FIGS. 2 and 3, the openings 30*h* and 30*i* are positioned to overlap the straight line L1 and the straight line L2.

In this embodiment, when viewed in a direction perpendicular to a radial direction of the supply-manifold-side opening 30*h*, a center of the supply manifold 30*a* in the width direction overlaps the supply-manifold-side opening 30*h*. Likewise, when viewed in a direction perpendicular to a radial direction of the return-manifold-side opening 30*i*, a center of the return manifold 30*b* in the width direction overlaps the return-manifold-side opening 30*i*. By way of example, the inside diameter of the return-manifold-side opening 30*i* is set to be less than or equal to the inside diameter of the supply-manifold-side opening 30*h*.

The channel unit 30 includes at least one elongate damper 35*a*. The damper 35*a* is disposed below the supply manifold 30*a* and above the return manifold 30*b*. When liquid in the supply manifold 30*a* and/or the return manifold 30*b* vibrates, the damper 35*a* elastically deforms in a thickness direction to damp the vibration. Thus, the damper 35*a* may reduce or prevent a pressure change in liquid in each of the manifolds 30*a* and 30*b*, thereby reducing crosstalk between a nozzle 31*a* ejecting liquid and an adjacent nozzle 31*a* whose ejection characteristics may otherwise be affected. In this embodiment, the damper 35*a* is formed by a portion of the plate 35 made of metal.

In the channel unit 30, the supply manifold 30*a* and the return manifold 30*b* face each other vertically across the damper 35*a*. When viewed in a direction perpendicular to a radial direction of the supply-manifold-side opening 30*h*, a center of the damper 35*a* in the width direction overlaps the supply-manifold-side opening 30*h*. Likewise, when viewed in a direction perpendicular to a radial direction of the return-manifold-side opening 30*i*, the center of the damper 35*a* in the width direction overlaps the return-manifold-side opening 30*i*. The center of the damper 35*a* in the width direction corresponds to a maximum displaced position of the damper 35*a*.

In the liquid ejection head 3 structured as described above, the pumps P1 through P3, when driven, apply a positive pressure to liquid in the supply manifold 30*a* and a negative pressure to liquid in the return manifold 30*b*. Thus, liquid flows from the supply manifold 30*a* toward the return manifold 30*b*. Also, liquid flows from the supply manifold 30*a* toward the return manifold 30*b*, via the individual channels 30*c*. Liquid in the return manifold 30*b* is discharged to an exterior and is supplied again into the supply manifold 30*a*.

A particular actuator 41, when driven in this state, applies a positive pressure to liquid in the pressure chamber 30*g* corresponding to the particular actuator 41. Thus, a positive pressure is applied to liquid in the descender 30*f* corresponding to the particular actuator 41, and the liquid is ejected from the nozzle 31*a* corresponding to the particular actuator 41.

In a known liquid ejection head, when any air is entrained into a supply manifold or a return manifold, the air may stagnate in the manifold at an area where the liquid flow velocity is relatively low. This may prevent normal ejection in a liquid ejection system.

In a known liquid ejection head, when liquid contains a particular component (e.g., when ink contains a colorant component), the particular component may settle in a liquid ejection head at an area where the liquid flow velocity is relatively low, or may settle in a channel of a liquid ejection system in an off state. This may cause the particular component to accumulate in the channel and narrow the channel, resulting in a liquid circulation failure or a clog in the channel.

The present applicants have found that the liquid flow velocity is relatively high at the central area of the supply manifold 30*a* in the width direction and at the central area of the return manifold 30*b*. Each of these areas is located in the manifold 30*a* or 30*b* at a position spaced enough, from opposite inner walls in the width direction, not to be affected by friction between liquid and the inner walls of the manifold 30*a* or 30*b*. Thus, any air entrained into the manifold 30*a* or 30*b* is more likely to circulate at the central area than at opposite sides in the width direction of the manifold 30*a* or 30*b*.

In this embodiment, the liquid ejection head 3 is structured based on such findings. As described above, each supply-manifold-side opening 30*h* is positioned to vertically overlap the central area of the supply manifold 30*a* in the width direction, and each return-manifold-side opening 30*i* is positioned to vertically overlap a central area of the return manifold 30*b*.

When any air is entrained into the supply manifold 30*a*, this structure allows the air to be quickly guided through the openings 30*h* to the individual channels 30*c* and discharged from the supply manifold 30*a*. When any air is entrained from the individual channels 30*c* through the openings 30*i* into the return manifold 30*b*, this structure also allows the air to quickly flow in the return manifold 30*b* and exit the return manifold 30*b*.

Liquid flows relatively fast at an area near the openings 30*h* in the supply manifold 30*a*, and at an area near the openings 30*i* in the return manifold 30*b*. Thus, settling of the particular component of liquid may be prevented at such areas, and a sediment formed in a channel may be reduced by being exposed to the flowing liquid. A stable liquid flow is thereby achieved in the liquid ejection head 3.

As described above, in the liquid ejection head 3, the supply manifold-side openings 30*h* of the supply throttles 30*d* are positioned in the supply manifold 30*a* at an area where the liquid flow velocity is relatively high, and thus facilitate discharge of air therethrough in the supply manifold 30*a* to the individual channels 30*c*. Likewise, the return manifold-side openings 30*i* of the supply throttles 30*e* are positioned in the return manifold 30*b* at an area where the liquid flow velocity is relatively high, and thus facilitate discharge of air therethrough in the return manifold 30*b* to the exterior. The liquid flows at a relatively high flow velocity at areas near the openings 30*h* and 30*i*, thereby preventing accumulation of the particular component of the liquid at these areas. Thus, proper liquid ejection performance is maintained in the liquid ejection head 3. Such an advantageous effect may be obtained particularly when the liquid ejection head 3 ejects a highly viscous ink containing a large amount of colorant components.

Further, the liquid ejection head 3 quickly ejects from the manifolds 30*a* and 30*b* a very small foreign substance entrained in liquid. This may prevent the foreign substance from narrowing or clogging a channel.

The liquid ejection head 3, which maintains stable ink ejection performance as described above, obviates the need to purge and discard liquid from the liquid ejection head 3. This may reduce a maintenance burden and waste liquid.

Further, when viewed in a direction perpendicular to a radial direction of each supply-manifold-side opening 30*h*, the center of the supply manifold 30*a* in the width direction overlap each supply-manifold-side opening 30*h*. When viewed in a direction perpendicular to a radial direction of each return-manifold-side opening 30*i*, the center of the return manifold 30*b* in the width direction overlaps each return-manifold-side opening 30*i*. The openings 30*h* and 30*i* are positioned at such areas as to accelerate the liquid flow velocity, thereby further improving the liquid ejection performance of the liquid ejection head 3.

Further, in the liquid ejection head 3, the supply manifold 30*a*, the return manifold 30*b*, and the damper 35*a* vertically face each other. When viewed in a direction perpendicular to the radial direction of each supply-manifold-side opening 30*h*, the center of the damper 35*a* in the width direction overlaps each supply-manifold-side opening 30*h*. When viewed in a direction perpendicular to the radial direction of each return-manifold-side opening 30*i*, the center of the damper 35*a* in the width direction overlaps each return-manifold-side opening 30*i*. The openings 30*h* and 30*i* are positioned to correspond to the maximum displaced position of the damper 35*a*, at which the damper 35*a* is displaced at maximum, to reliably damp the vibration of liquid.

Further, the inside diameter of each return-manifold-side opening 30*i* is set to be less than or equal to the inside diameter of each supply-manifold-side opening 30*h*. This may prevent any air entrained into the liquid in the return throttle 30*e* from being trapped by an inner wall of the return throttle 30*e*, thereby facilitating discharge of the air toward the return manifold 30*b*.

The inside diameters of the supply throttle 30*d* and the return throttle 30*e* may be suitably selected. By selecting a relatively small diameter for the throttles 30*d* and 30*e* within the tolerance of pressure loss, the liquid flow velocity and the air discharge velocity increase.

Modifications

Figure 4:
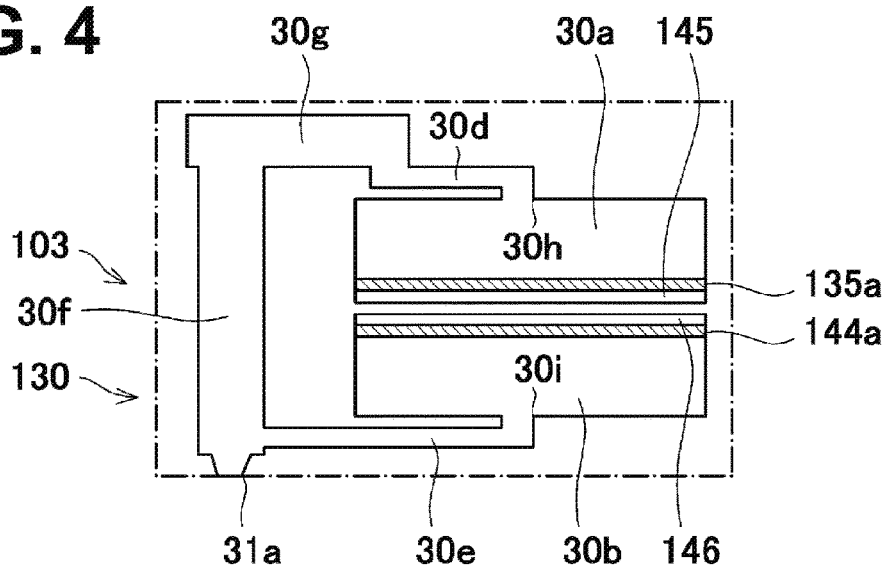
FIG. 4 is a partial cross-sectional view of a liquid ejection head, when viewed in a longitudinal direction of each manifold, according to a modification of the first illustrative embodiment.

Modifications of the first illustrative embodiment will now be described. FIG. 4 is a partial cross-sectional view of a liquid ejection head 103, when viewed in a longitudinal direction of manifolds 30*a* and 30*b*, according to a modification of the first illustrative embodiment. FIG. 4 is related to FIG. 2. A cross-sectional structure of the liquid ejection head 103 is schematically shown in FIG. 4.

As shown in FIG. 4, a damper unit of the liquid ejection head 103 is disposed blow the supply manifold 30*a* and above the return manifold 30*b*, and includes a supply-side damper 135*a* closer to the supply manifold 30*a*, and a return-side damper 144*a* closer to the return manifold 30*b*. The damper 135*a* and 144*a* are structured similarly to each other but may be structured differently from each other. A space 145 is provided below the supply-side damper 135*a* to allow the damper 135*a* to vibrate. A space 146 is provided above the return-side damper 144*a* to allow the damper 144*a* to vibrate.

The dampers 135*a* and 144*a* are respectively disposed at the manifolds 30*a* and 30*b* in a channel unit 30. This may further improve the damping effect on the vibration of liquid.

Each individual channel 30*c* in a liquid ejection head according to a second modification defines a flow path and includes a pressure chamber 30*g*, as in the liquid ejection head 3. The maximum flow path resistance value of a supply throttle 30*d* is set to be greater than or equal to that of a return throttle 30*e*.

In the liquid ejection head 3 according to the first embodiment, pressure from a pressure chamber 30*g*, which is disposed at a liquid supply side, is more likely to act on liquid in a supply throttle 30*d* than on liquid in a return throttle 30*e*.

In this second modification, a difference in pressure loss between the supply throttle 30*d* and the return throttle 30*e* is reduced by setting the maximum flow path resistance value of the supply throttle 30*d* to be greater than or equal to that of the return throttle 30*e*. Even when the pressure chamber 30*g* is disposed closer to the supply throttle 30*d*, the above setting facilitates discharge, from the return manifold 30*b*, of air entrained in liquid and reduces settling of a particular component in liquid near openings 30*h* or 30*i*.

Specifically, the liquid ejection head according to the second modification may be realized by setting the minimum flow path cross-sectional area of the supply throttle 30*d* to be less than that of the return throttle 30*e*. Alternatively, the liquid ejection head according to the second modification may be realized by setting the flow path length of the supply throttle 30*d* to be greater than that of the return throttle 30*e*.

Each of the above structures allows setting the maximum flow path resistance value of the supply throttle 30*d* to be greater than or equal to that of the return throttle 30*e*, thereby reducing a difference in pressure loss between the throttles 30*d* and 30*e*. Other illustrative embodiments will now be described by focusing mainly on differences from the first illustrative embodiment.

Second Illustrative Embodiment

Figure 5:
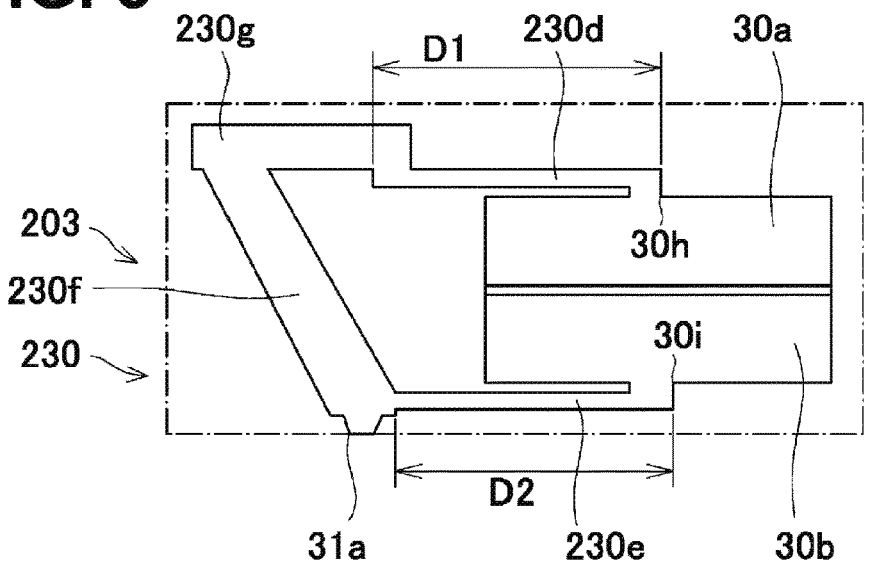
FIG. 5 is a partial cross-sectional view of a liquid ejection head, when viewed in a longitudinal direction of each manifold, according to a second illustrative embodiment.

FIG. 5 is a partial cross-sectional view of a liquid ejection head 203, when viewed in a longitudinal direction of manifolds 30*a* and 30*b*, according to a second illustrative embodiment. FIG. 5 is related to FIG. 2. A cross-sectional structure of the liquid ejection head 203 is schematically shown in FIG. 5.

As shown in FIG. 5, the shortest distance between an upstream end (closer to a supply throttle 230*d*) of a descender 230*f* and a supply-manifold-side opening 30*h* is greater than the shortest distance between a downstream end (closer to a return throttle 230*e*) of the descender 230*f* and the return-manifold-side opening 30*i*. The descender 230*f* extends obliquely from the upstream end to the downstream end such that its more downstream portion is closer to the return manifold 30*b*. Thus, a lengthwise dimension D1 of the supply throttle 230*d* is set to be substantially equal to (herein, slightly greater than) a lengthwise dimension D2 of the return throttle 230*e*. In an example shown in FIG. 5, the descender 230*f* extends down from a pressure chamber 230*g* obliquely such that a longitudinal direction of the descender 230*f* crosses a longitudinal direction of the pressure chamber 230*g*. A nozzle 31*a* of the liquid ejection head 203 is located closer to a center of the return manifold 30*b* in a width direction as compared with a nozzle 31*a* of the liquid ejection head 3 in which the descender 30*f* extends along the stacking direction.

In the above structure, by setting the dimensions D1 and D2 in the width direction to be substantially equal to each other, a difference in pressure loss between a passage connecting the upstream end of the descender 230*f* and the opening 30*h*, and a passage connecting the downstream end of the descender 230*f* and the opening 30*i* may be reduced. Even when the pressure chamber 230*g* is disposed closer to the supply throttle 230*d*, the above setting facilitates discharge, from the return manifold 30*b*, of air entrained in liquid and reduces settling of a particular component in liquid near the openings 30*h* and 30*i*.

Third Illustrative Embodiment

Figure 6:
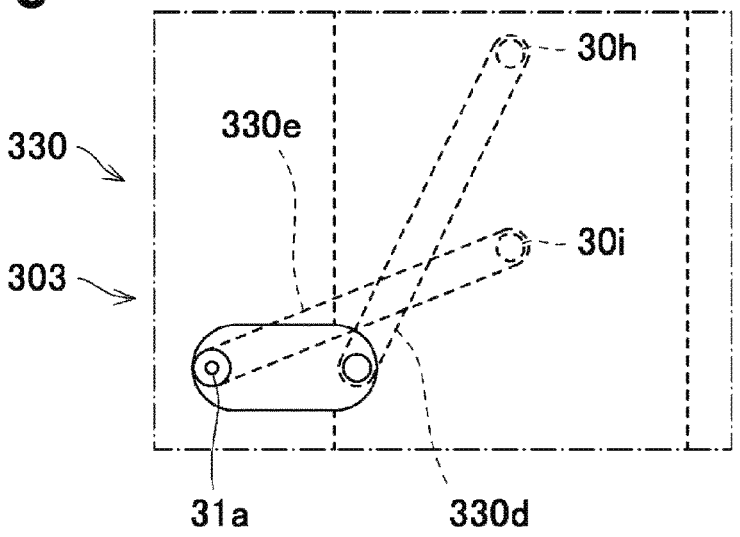
FIG. 6 is a partial cross-sectional view of a liquid ejection head, when viewed in a stacking direction, according to a third illustrative embodiment.

FIG. 6 is a partial cross-sectional view of a liquid ejection head 303, when viewed in a stacking direction, according to a third illustrative embodiment. FIG. 6 is related to a part of FIG. 3. As shown in FIG. 6, in a channel unit 330 of the liquid ejection head 303, a supply throttle 330*d* is longer than a return throttle 330*e* when viewed in a direction perpendicular to a radial direction of a supply-manifold-side opening 30*h*. When viewed in this direction, the supply throttle 330*d* extends straight but may extend in a curved or bent manner.

In the above structure, by setting the flow path length of the supply throttle 30*d* to be substantially equal to that of the return throttle 330*e*, substantially an equal pressure may be applied to liquid flowing at an upstream side and to liquid flowing at a downstream side of the nozzle 31*a*. Thus, a difference in pressure loss between the above passages may be reduced. Even when the pressure chamber 30*g* is disposed closer to the supply throttle 330*d*, the above setting facilitates discharge, from the return manifold 30*b*, of air entrained in liquid and reduces settling of a particular component in liquid near openings 30*h* and 30*i*.

By this method in the above structure, variations in flow path resistance value between the supply throttle 330*d* and the return throttle 330*e* may be reduced further than by a method for adjusting the flow path cross-sectional areas for the supply throttle 330*d* and the return throttle 330*e*. It should be noted that the dimension of the supply throttle 330*d* in a width direction may be set to be less than that of the return throttle 330*e* when viewed in a direction perpendicular to a radial direction of a supply-manifold-side opening 30*h*.

While the disclosure has been described with reference to particular embodiments, various changes, additions, and deletions may be applied therein without departing from the spirit and scope of the disclosure. The number of plates forming the channel unit 30 is not limited to that disclosed herein and may be suitably changed. The supply throttle 30*d* and the return throttle 30*e* may be equal in flow path cross-sectional area. This may prevent air entrained in liquid from being trapped at the supply throttle 30*d* and the return throttle 30*e*.

What is claimed is:

1. A liquid ejection apparatus comprising:

a supply manifold which is elongate and in which liquid flows;

a return manifold which is elongate and in which liquid flows, the return manifold vertically overlapping the supply manifold;

a plurality of individual channels each connecting the supply manifold and the return manifold, each of the plurality of individual channels including:

a supply throttle connected, at a supply-manifold-side opening thereof, to the supply manifold;

a return throttle connected, at a return-manifold-side opening thereof, to the return manifold;

a nozzle from which liquid is ejected; and a descender connecting the supply throttle and the return throttle, and connected to the nozzle, wherein the supply-manifold-side opening of the supply throttle is positioned to vertically overlap a central area of the supply manifold in a width direction, and the return-manifold-side opening of the return throttle is positioned to vertically overlap a central area of the return manifold in the width direction.

2. The liquid ejection apparatus according to claim 1, wherein a center of the supply manifold in the width direction overlaps the supply-manifold-side opening when viewed in a direction perpendicular to a radial direction of the supply-manifold-side opening, and wherein a center of the return manifold in the width direction overlaps the return-manifold-side opening when viewed in a direction perpendicular to a radial direction of the return-manifold-side opening.

3. The liquid ejection apparatus according to claim 1, further comprising:

at least one damper which is elongate, disposed vertically between the supply manifold and the return manifold, and configured to damp vibration of liquid in the supply manifold and in the return manifold, wherein the supply manifold, the return manifold, and the at least one damper vertically face each other, wherein a center of the at least one damper in the width direction overlaps the supply-manifold-side opening when viewed in a direction perpendicular to a radial direction of the supply-manifold-side opening, and wherein the center of the at least one damper in the width direction overlaps the return-manifold-side opening when viewed in a direction perpendicular to a radial direction of the return-manifold-side opening.

4. The liquid ejection apparatus according to claim 3, wherein the at least one damper includes a supply-side damper and a return-side damper which are disposed between the supply manifold and the return manifold, the supply-side damper being closer to the supply manifold than the return-side damper is to the supply manifold.

5. The liquid ejection apparatus according to claim 1, wherein an inside diameter of the return-manifold-side opening is less than or equal to an inside diameter of the supply-manifold-side opening.

6. The liquid ejection apparatus according to claim 1, wherein each of the plurality of individual channels further includes a pressure chamber disposed between the supply throttle and the descender, and configured to apply pressure to liquid supplied from the supply throttle to supply the liquid to the descender, and wherein the supply throttle has a maximum flow path resistance value greater than or equal to that of the return throttle.

7. The liquid ejection apparatus according to claim 6, wherein the supply throttle has a minimum flow path cross-sectional area less than that of the return throttle.

8. The liquid ejection apparatus according to claim 6, wherein the supply throttle has a flow path length greater than that of the return throttle.

9. The liquid ejection apparatus according to claim 6, wherein the descender has an upstream end closer to the supply throttle, and a downstream end closer to the return throttle, and a shortest distance between the upstream end of the descender and the supply-manifold-side opening is greater than a shortest distance between the downstream end of the descender and the return-manifold-side opening, and the descender extends obliquely from the upstream end to the downstream end such that a more downstream portion thereof is closer to the return manifold.

10. The liquid ejection apparatus according to claim 6, wherein the supply throttle is longer than the return throttle when viewed in a direction perpendicular to a radial direction of the supply-manifold-side opening.

* * * * *